US008643581B2

(12) United States Patent
Kikuta

(10) Patent No.: US 8,643,581 B2
(45) Date of Patent: Feb. 4, 2014

(54) IMAGE PROCESSING DEVICE, DISPLAY SYSTEM, ELECTRONIC APPARATUS, AND IMAGE PROCESSING METHOD

(75) Inventor: Kazuto Kikuta, Hachioji (JP)

(73) Assignee: Seiko Epson Corporation (JP)

( * ) Notice: Subject to any disclaimer, the term of this patent is extended or adjusted under 35 U.S.C. 154(b) by 499 days.

(21) Appl. No.: 13/047,099

(22) Filed: Mar. 14, 2011

(65) Prior Publication Data

US 2011/0227961 A1 Sep. 22, 2011

(30) Foreign Application Priority Data

Mar. 18, 2010 (JP) ..... 2010-062096

(51) Int. Cl.
*G09G 3/36* (2006.01)

(52) U.S. Cl.
USPC ..... 345/98; 345/99; 345/100

(58) Field of Classification Search
USPC ..... 345/98–100
See application file for complete search history.

(56) References Cited

U.S. PATENT DOCUMENTS

| | | | | |
|---|---|---|---|---|
| 6,559,839 | B1 * | 5/2003 | Ueno et al. | 345/213 |
| 2005/0248557 | A1 | 11/2005 | Miyazawa | |
| 2008/0143729 | A1 | 6/2008 | Wyatt et al. | |
| 2008/0297463 | A1 | 12/2008 | Tsuru et al. | |
| 2009/0110377 | A1 * | 4/2009 | Unoki et al. | 386/131 |
| 2009/0185795 | A1 * | 7/2009 | Itani et al. | 386/131 |
| 2011/0043551 | A1 * | 2/2011 | Kikuta | 345/691 |
| 2011/0227961 | A1 * | 9/2011 | Kikuta | 345/690 |

FOREIGN PATENT DOCUMENTS

| | | | |
|---|---|---|---|
| CN | 1691748 | A | 11/2005 |
| CN | 101231832 | A | 7/2008 |
| JP | 2007-304318 | | 11/2007 |
| JP | 2008-197626 | | 8/2008 |

* cited by examiner

*Primary Examiner* — Waseem Moorad
(74) *Attorney, Agent, or Firm* — Harness, Dickey & Pierce, P.L.C.

(57) ABSTRACT

An image processing device performing a frame rate control a display timing control signal corresponding to an image data, includes: a brightness distribution generating unit that generates a brightness distribution on the basis of the image data; an image type determining unit that determines a type of an image on the basis of the brightness distribution; and a frame rate control unit that performs frame rate control corresponding to the determined image type.

7 Claims, 13 Drawing Sheets

FIG. 9A

| LINE | 0 | | | | | | | | | | | |
|---|---|---|---|---|---|---|---|---|---|---|---|---|
| PIXEL | 0 | 1 | 2 | 3 | 4 | 5 | 6 | 7 | 8 | 9 | 10 | ····· |
| Y | 2 | 2 | 3 | 5 | 5 | 10 | 5 | 10 | 20 | 5 | 1 | ····· |
| BRIGHTNESS DIFFERENCE | 0 | 0 | 1 | 2 | 0 | 5 | 5 | 5 | 10 | 15 | 4 | ····· |

FIG. 9B

| BRIGHTNESS DIFFERENCE | 0 | 2 | 4 | 6 | 8 | 10 | 12 | 14 | 16 | 18 | 20 |
|---|---|---|---|---|---|---|---|---|---|---|---|
| COUNT NUMBER | 4 | 1 | 4 | 0 | 0 | 1 | 0 | 1 | 0 | 0 | 0 |

IMAGE PROCESSING DEVICE, DISPLAY SYSTEM, ELECTRONIC APPARATUS, AND IMAGE PROCESSING METHOD

The entire disclosure of Japanese Patent Application No. 2010-062096, filed Mar. 18, 2010, is expressly incorporated by reference herein.

BACKGROUND

1. Technical Field

An aspect of the present invention relates to an image processing device, a display system, an electronic apparatus, and an image processing method.

2. Related Art

Recently, LCD (Liquid Crystal Display) panels using liquid crystal elements as display elements or display panels (display devices) using organic light emitting diodes (hereinafter, abbreviated as "OLED") (light-emitting elements in a broad sense) as display elements have been widely spread. The OLED has a higher response speed than that of the liquid crystal element and improves the contrast ratio. By using the display panel in which such OLEDs are arranged in a matrix shape, it is possible to display an image with a large viewing angle and high image quality.

However, when the time in which the same light-emitting element is lit with the same brightness lasts longer such as when a still image is displayed for a long time, a so-called burn-in phenomenon occurs even in the display panel using the OLED, thereby deteriorating the image quality. A technique of preventing the burn-in phenomenon in the display panel using the OLED is disclosed, for example, in JP-A-2007-304318 and JP-A-2008-197626.

JP-A-2007-304318 discloses an OLED display device in which a display position is shifted by a predetermined distance at a predetermined interval of time while controlling the gray scale of an image on the basis of a current value applied as an image signal or a length of time for applying a constant current. JP-A-2008-197626 discloses a technique of reducing a visual symptom for changing a refresh rate of a display.

On the other hand, the above-mentioned high-speed response characteristic of the OLED can enhance the usability of frame rate control on the OLED. For example, when the frame rate control is performed at the time of displaying an image on a display panel using the OLED, more gradation in gray scale can be expressed, thereby displaying an image with higher image quality, in comparison with the case where the frame rate control is performed at the time of displaying an image on an LCD panel. In this way, by performing the frame rate control, it is possible to prevent the burn-in phenomenon and to improve the image quality.

However, in the techniques disclosed in JP-A-2007-304318 and JP-A-2008-197626, the above-mentioned control is performed regardless of the type of an image input. Accordingly, the image quality may not be improved or the burn-in phenomenon may not be satisfactorily prevented, depending on the display panels or the display images.

SUMMARY

An advantage of some aspects of the invention is that it provides an image processing device, a display system, an electronic apparatus, and an image processing method, which can display an image with higher image quality and prevent the burn-in phenomenon regardless of display panels or display images.

According to an aspect of the invention, there is provided an image processing device performing a frame rate control on image data corresponding to a display image or a display timing control signal corresponding to the image data. The image processing device includes: a brightness distribution generating unit that generates a brightness distribution on the basis of the image data in terms of a block which is obtained by dividing the display image on a screen into a plurality of blocks; an image type determining unit that determines a type of an image on the basis of the brightness distribution in terms of the block; and a frame rate control unit that performs the frame rate control corresponding to the determined image type in terms of the block.

According to this configuration, the type of an image is determined in terms of a block which is obtained by dividing a screen into plural blocks and a frame rate control corresponding to the determined type is performed. Accordingly, it is possible to reduce the flicker accompanying the frame rate control and to display an image with higher image quality regardless of the display panels or the display images. It is also possible to prevent the burn-in phenomenon and to extend the lifetime of a display panel or a display element.

In another aspect of the invention, in the image processing device, the brightness distribution generating unit includes: a first brightness distribution generator that generates the brightness distribution in a first direction of the display image; and a second brightness distribution generator that generates the brightness distribution in a second direction of the display image intersecting the first direction. Here, the image type determining unit determines the type of an image on the basis of the brightness distribution in the first direction and the brightness distribution in the second direction.

According to this configuration, since the image type is determined in terms of the block on the basis of the brightness distribution in the first direction of the display image and the brightness distribution in the second direction, it is possible to determine the type of an image having a feature in the first direction and the second direction.

In still another aspect of the invention, in the image processing device, the frame rate control unit outputs the image data and the display timing control signal in a mode corresponding to the image type determined by the image type determining unit between a first mode in which an interlaced scanning operation and a progressive scanning operation are switched after each first interval of time, a second mode in which a frame rate decreases every dot, a third mode in which an image display is thinned out every given frame, and a fourth mode in which an image is shifted by one dot relative to the original display image after a second interval of time has elapsed.

According to this configuration, it is possible to reduce the number of times of lighting of each dot for displaying the display image and to shorten the lighting time. It is also possible to extend the lifetime of the display elements which deteriorate in proportion to the lighting time, and to extend the lifetime of a display panel including the display elements.

In yet another aspect of the invention, in the image processing device, the frame rate control unit performs the frame rate control corresponding to the image type on a frame subsequent to the frame of which the image type has been determined by the image type determining unit.

According to this configuration, since the frame rate control is performed on the frame subsequent to the frame of which the image type has been determined, it is possible to display an image with higher image quality and to prevent the burn-in phenomenon, without increasing the processing load.

In still yet another aspect of the invention, in the image processing device, the image type determining unit determines the image type when the display image is a still image.

According to this configuration, the control is not performed on a moving image for which it is difficult to obtain the advantage of the frame rate control, thereby displaying a still image with higher image quality and preventing the burn-in phenomenon.

According to further another aspect of the invention, there is provided a display system including: a display panel that includes a plurality of row signal lines, a plurality of column signal lines disposed to intersect the plurality of row signal lines, and a plurality of light-emitting elements each being specified by one of the plurality of row signal lines and one of the plurality of column signal lines and emitting light with a brightness corresponding to driving current; a row driver that drives the plurality of row signal lines; a column driver that drives the plurality of column signal lines; and the above-mentioned image processing device. Here, the display image is displayed on the basis of the image data or the display timing control signal having been subjected to the frame rate control by the image processing device.

According to this configuration, it is possible to provide a display system which can display an image with higher image quality and prevent the burn-in phenomenon, regardless of the display panel or the display image.

According to still further another aspect of the invention, there is provided an electronic apparatus including the above-mentioned image processing device.

According to this configuration, it is possible to provide an electronic apparatus which can display an image with higher image quality and prevent the burn-in phenomenon, regardless of the display panel or the display image.

According to yet further another aspect of the invention, there is provided an image processing method of performing a frame rate control on image data corresponding to a display image or a display timing control signal corresponding to the image data. The image processing method includes: generating a brightness distribution on the basis of the image data in terms of a block which is obtained by dividing the display image on a screen into a plurality of blocks; determining the type of an image on the basis of the brightness distribution in terms of the block; and performing the frame rate control corresponding to the determined image type in terms of the block.

According to this configuration, the type of an image is determined in terms of a block which is obtained by dividing a screen into plural blocks and a frame rate control corresponding to the determined type is performed. Accordingly, it is possible to reduce the flicker accompanying the frame rate control and to display an image with higher image quality regardless of the display panels or the display images. It is also possible to prevent the burn-in phenomenon and to extend the lifetime of a display panel or a display element.

In still yet further another aspect of the invention, in the image processing method, the performing of the frame rate control includes outputting the image data and the display timing control signal in a mode corresponding to the determined image type between a first mode in which an interlaced scanning operation and a progressive scanning operation are switched after each first interval of time, a second mode in which a frame rate decreases every dot, a third mode in which an image display is thinned out every given frame, and a fourth mode in which an image is shifted by one dot relative to the original display image after a second interval of time has elapsed.

According to this configuration, it is possible to reduce the number of times of lighting of each dot for displaying the display image and to shorten the lighting time. It is also possible to extend the lifetime of the display elements deteriorating in proportion to the lighting time and to extend the lifetime of a display panel including the display elements.

In a further aspect of the invention, in the image processing method, the determining of the image type includes determining the image type when the display image is a still image.

According to this configuration, the control is not performed on a moving image for which it is difficult to obtain the advantage of the frame rate control, thereby displaying a still image with higher image quality and preventing the burn-in phenomenon.

BRIEF DESCRIPTION OF THE DRAWINGS

The invention will be described with reference to the accompanying drawings, wherein like numbers reference like elements.

FIGS. 9A and 9B are diagrams illustrating a brightness distribution generating process of step S12 in FIG. 8.

DESCRIPTION OF EXEMPLARY EMBODIMENTS

Hereinafter, exemplary embodiments of the invention will be described in detail with reference to the accompanying drawings. The following embodiments are not intended to limit the details of the invention described in the appended claims. All the configurations described below are not essential to accomplish the above-mentioned advantages.

Figure 1:
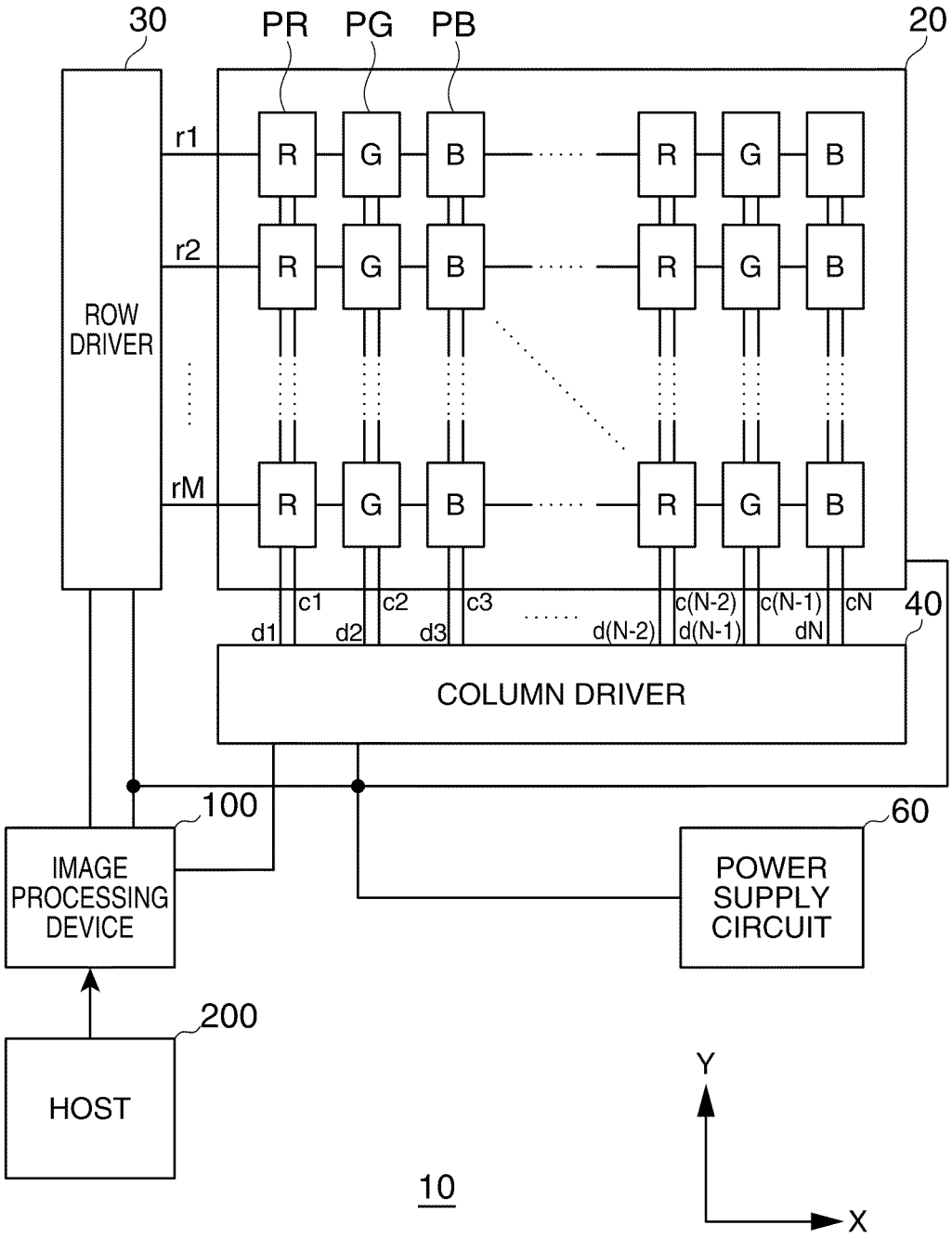
FIG. 1 is a block diagram illustrating the configuration of a display system according to an embodiment of the invention.

FIG. 1 is a block diagram illustrating the configuration of a display system according to an embodiment of the invention. The display system includes a display panel (light-emitting panel) using OLEDs which are light-emitting elements as display elements. Each OLED is driven by a row driver and a column driver on the basis of image data and a display timing control signal generated by an image processing device.

The display system 10 shown in FIG. 1 includes a display panel 20, a row driver 30, a column driver 40, a power supply circuit 60, an image processing device 100, and a host 200. In the display panel 20, plural data signal lines d1 to dN (where N is an integer equal to or greater than 2) and plural column signal lines c1 to cN extending in the Y direction are arranged in the X direction. In the display panel 20, plural row signal lines r1 to rM (where M is an integer equal to or greater than 2) extending in the X direction so as to intersect the column signal lines and the data signal lines are arranged in the Y direction. A pixel circuit is formed at an intersection of each column signal line (more specifically, each column signal line and each data line) and each row signal line. Plural pixel circuits are arranged in a matrix shape in the display panel 20.

In FIG. 1, one dot is constructed by an R-component pixel circuit PR, a G-component pixel circuit PG, and a B-component pixel circuit PB adjacent to each other in the X direction. The R-component pixel circuit PR includes an OLED emitting light with a red display color, the G-component pixel circuit PG includes an OLED emitting light with a green display color, and the B-component pixel circuit PB includes an OLED emitting light with a blue display color.

The row driver 30 is connected to the row signal lines r1 to rM of the display panel 20. The row driver 30 sequentially selects the row signal lines r1 to rM of the display panel 20, for example, in a vertical scanning period and outputs a selection pulse in a selection period of each row signal line.

The column driver 40 is connected to the data signal lines d1 to dN and the column signal lines c1 to cN of the display panel 20. The column driver 40 applies a given source voltage to the column signal lines c1 to cN and applies a gray-scale voltage corresponding to image data of one line to the data signal lines, for example, every horizontal scanning period.

Accordingly, in the horizontal scanning period in which the j-th row (where j is an integer satisfying $1 \leq j \leq M$) is selected, a gray-scale voltage corresponding to the image data is applied to the pixel circuit in the k-th column (where k is an integer satisfying $1 \leq k \leq N$) of the j-th row. In the pixel circuit of the j-th row and the k-th column, when a selection pulse is applied to the row signal line rj from the row driver 30, the voltage, which corresponds to the image data, applied to the data signal line dk from the column driver 40 is applied to the gate of a driving transistor of the pixel circuit. At this time, when a given source voltage is applied to the column signal line ck, the driving transistor is turned on and driving current flows in the OLED of the pixel circuit. In this way, the row driver 30 and the column driver 40 can supply the driving current corresponding to the image data to the OLEDs of the pixels connected to the row signal line sequentially selected in one vertical scanning period.

The host 200 generates the image data corresponding to a display image. The image data generated by the host 200 is sent to the image processing device 100. The image processing device 100 performs a frame rate control (hereinafter, abbreviated as FRC) at the time of displaying an image based on the image data from the host 200. The image data having been subjected to the FRC by the image processing device 100 is supplied to the column driver 40. The display timing control signal corresponding to the image data having been subjected to the FRC by the image processing device 100 is supplied to the row driver 30 and the column driver 40. The power supply circuit 60 generates plural types of source voltages and supplies the source voltages to the display panel 20, the row driver 30, the column driver 40, and the image processing device 100.

Figure 2:
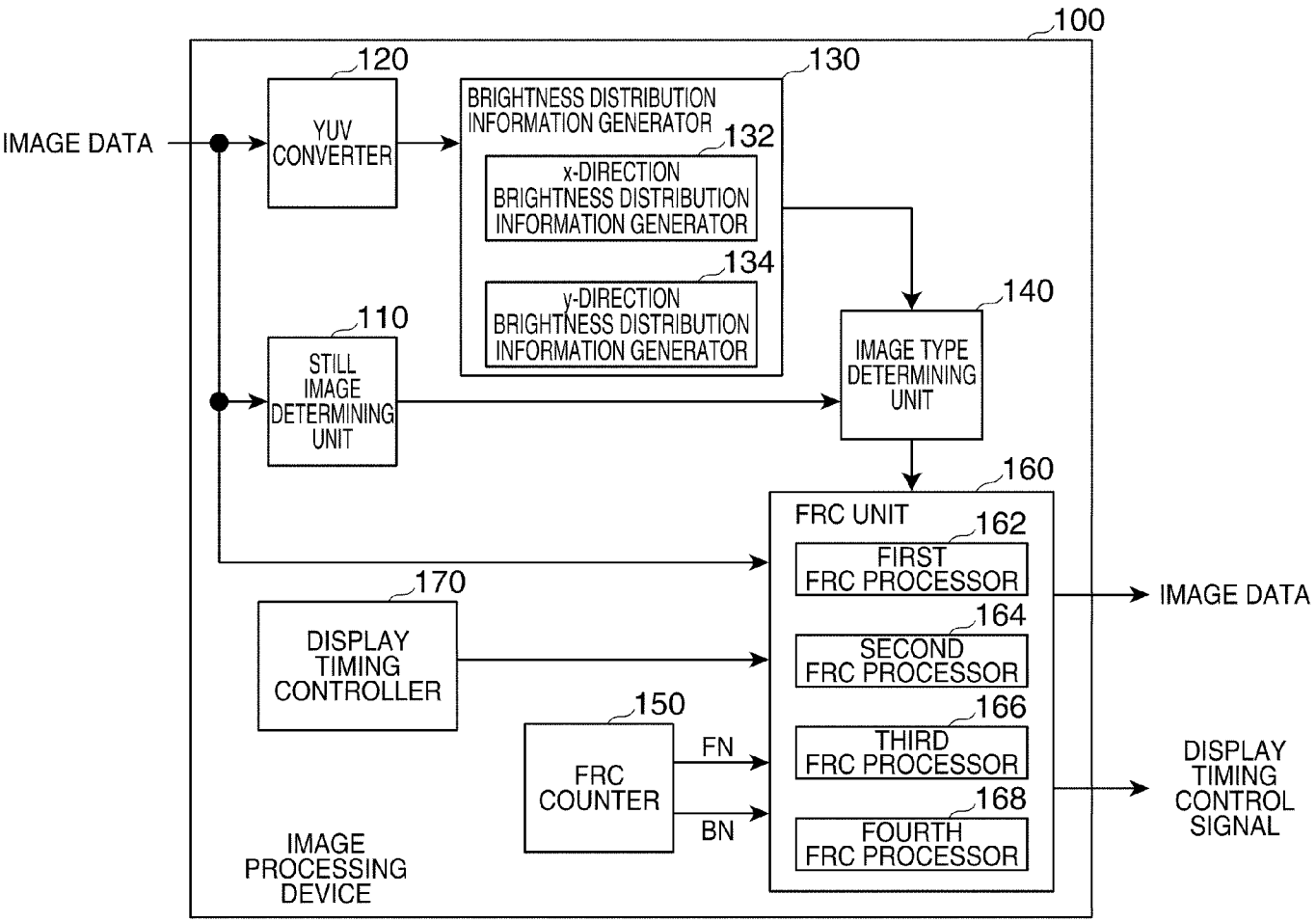
FIG. 2 is a block diagram illustrating the configuration of an image processing device shown in FIG. 1.

FIG. 2 is a block diagram illustrating the configuration of the image processing device 100 shown in FIG. 1.

The image processing device 100 includes a still image determining unit 110, a YUV converter 120, a brightness distribution information generator 130, an image type determining unit 140, an FRC counter 150, an FRC unit (frame rate controller) 160, and a display timing controller 170. The brightness distribution information generator 130 includes an x-direction brightness distribution information generator 132 (the first brightness distribution generator) and a y-direction brightness distribution information generator 134 (the second brightness distribution generator). The FRC unit 160 includes a first FRC processor 162, a second FRC processor 164, a third FRC processor 166, and a fourth FRC processor 168.

The still image determining unit 110 determines whether the image data supplied from the host 200 is image data of a still image. Accordingly, the still image determining unit 110 detects whether frames of which an image to be displayed is a still image are continuous on the basis of the image data from the host 200. When it is detected that the frames of a still image are continuous, the still image determining unit 110 determines that the image data from the host 200 is the image data of a still image. The YUV converter 120 converts the image data of an RGB format from the host 200 into YUV data including brightness data Y and color difference data UV.

The brightness distribution information generator 130 generates the brightness distribution information on the basis of the brightness data Y acquired from the YUV converter 120. More specifically, the brightness distribution information generator 130 generates the brightness distribution information in terms of a block which is obtained by dividing a screen into plural blocks. The x-direction brightness distribution information generator 132 generates x-direction brightness distribution information (the brightness distribution in the first direction) indicating a histogram of brightness differences between dots adjacent to each other in the x direction (the horizontal direction of an image) in each block. The y-direction brightness distribution information generator 134 generates y-direction brightness distribution information (the brightness distribution in the second direction intersecting the first direction) indicating a histogram of brightness differences between dots adjacent to each other in the y direction (the vertical direction of an image) of each block.

The image type determining unit 140 determines a type of an image represented by the image data from the host 200 on the basis of the brightness distribution information generated by the brightness distribution information generator 130. Here, the image type determined by the image type determining unit 140 is a type corresponding to one of plural types of FRCs performed by the FRC unit 160. The image type determining unit 140 determines the image type on the basis of at least one of the x-direction brightness distribution information generated by the x-direction brightness distribution information generator 132 and the y-direction brightness distribution information generated by the y-direction brightness distribution information generator 134. Accordingly, it is possible to perform the FRC optimal for an image having a feature in the x direction or the y direction of the image.

The FRC counter 150 generates a frame number FN or a block number BN used in the FRC performed by the FRC unit 160. The FRC counter 150 counts the number of frames of an image of which the display is controlled and outputs the frame number FN for specifying the counted frame. The FRC counter 150 manages the blocks divided from the image of which the display is controlled and outputs the block number BN specifying the block being subjected to the FRC.

Figure 3:
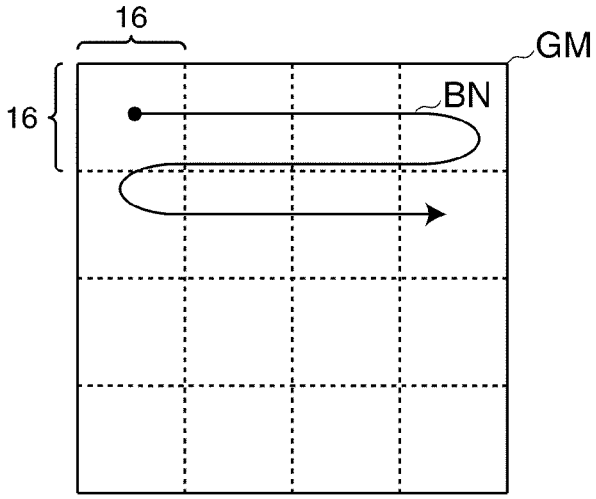
FIG. 3 is a diagram illustrating an operation of a frame rate control counter.

FIG. 3 is a diagram illustrating the operation of the FRC counter 150. FIG. 3 schematically shows an image on a screen.

In this embodiment, for example, an image on a screen is divided into plural blocks each having 16 dots×16 lines and the FRC is performed on each block. Accordingly, the FRC counter 150 manages a block to be processed in an image GM of the frame specified by the frame number FN in synchronization with the image data supplied from the host 200. The block to be processed is specified by the block number BN. Accordingly, the FRC unit 160 can differently perform the FRC on the blocks by performing the FRC corresponding to the image type determined in terms of a block by the image type determining unit 140 for each block.

In FIG. 2, the FRC unit 160 performs the FRC on the image data of a still image or the display timing control signal synchronized therewith, when the still image determining unit 110 determines that the image is a still image. At this time, the FRC unit 160 performs the FRC corresponding to the image type determined by the image type determining unit 140 on the block specified by the block number BN on the basis of the frame number FN. The FRC unit 160 performs the FRC on the image data or the display timing control signal from the host 200 by the use of any of the first FRC processor 162 to the fourth FRC processor 168 provided to correspond to the determined image types.

The first FRC processor 162 performs the FRC in a first mode and outputs the image data having been subjected to the FRC in the first mode and the display timing control signal synchronized therewith. The second FRC processor 164 performs the FRC in a second mode and outputs the image data having been subjected to the FRC in the second mode and the display timing control signal synchronized therewith. The third FRC processor 166 performs the FRC in a third mode and outputs the image data having been subjected to the FRC in the third mode and the display timing control signal synchronized therewith. The fourth FRC processor 168 performs the FRC in a fourth mode and outputs the image data having been subjected to the FRC in the fourth mode and the display timing control signal synchronized therewith.

The display timing controller 170 generates the display timing control signal. Examples of the display timing control signal includes a horizontal synchronization signal HSYNC specifying a horizontal scanning period, a vertical synchronization signal VSYNC specifying a vertical scanning period, a start pulse STH in the horizontal scanning direction, a start pulse STV in the vertical scanning direction, and a dot clock DCLK. The FRC processors of the FRC unit 160 perform the FRC by performing the control on the display timing control signal generated by the display timing controller 170 or performing the control of the image data from the host 200.

The FRCs in the first to fourth modes performed by the first FRC processor 162 to the fourth FRC processor 168 of the FRC unit 160 can employ, for example, the following FRCs.

Figure 4:
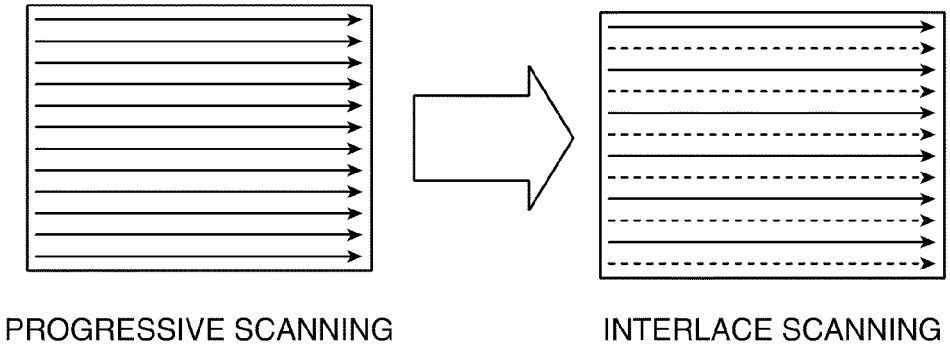
FIG. 4 is a diagram illustrating a frame rate control in a first mode.

FIG. 4 is a diagram illustrating the FRC in the first mode. FIG. 4 schematically illustrates a variation in a display image on the screen of the display panel 20 at the time of performing the FRC in the first mode.

The FRC in the first mode is a mode in which an interlaced scanning operation and a progressive scanning operation are switched after each first interval of time. For example, the progressive scanning operation in which the lines of an image are displayed regardless of an even frame or an odd frame is performed as a normal operation. When it is switched to the first mode, the interlaced scanning operation in which even lines are displayed for even frames and odd lines are displayed for odd frames is performed. Accordingly, it is possible to display the pixels of an image with different brightnesses every given interval of time and to control the lighting time of the OLEDs, thereby preventing the burn-in phenomenon and extending the lifetime of the display panel 20 or the OLEDs.

Figure 5:
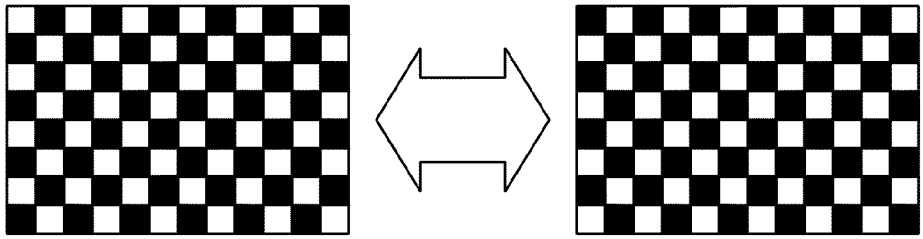
FIG. 5 is a diagram illustrating the frame rate control in a second mode.

FIG. 5 is a diagram illustrating the FRC in the second mode. FIG. 5 schematically illustrates a variation in screen scanning method of the display panel 20 at the time of performing the FRC in the second mode.

The FRC in the second mode is a mode in which the frame rate is decreased every pixel or dot by inverting every pixel constituting one dot or every dot. For example, the lines of an image are displayed regardless of an even frame or an odd frame as a normal operation. When it is switched to the second mode, image data of black dots in which the pixel values of the R components, the G components, and the B components are "0" is generated as the image data of d dots of h lines of f frames. Here, integers p, q, and r are determined to satisfy $f=2\times p$, $h=2\times q$, and $d=2\times r$. Image data of black dots are generated as the image data of (d+1) dots of (h+1) lines of f frames. Image data of black dots are generated as the image data of (d+1) dots of h lines of (f+1) frames. Image data of black dots are generated as the image data of d dots of (h+1) lines of (f+1) frames. In this way, for example, in the even frames, even dots of even lines and odd dots of odd lines can be displayed as black dots. In the odd frames, odd dots of even lines and even dots of odd lines can be displayed as black dots. Accordingly, it is possible to display the pixels of an image with different brightnesses every given interval of time and to control the lighting time of the OLEDs, thereby preventing the burn-in phenomenon and extending the lifetime of the display panel 20 or the OLEDs.

Figure 6:
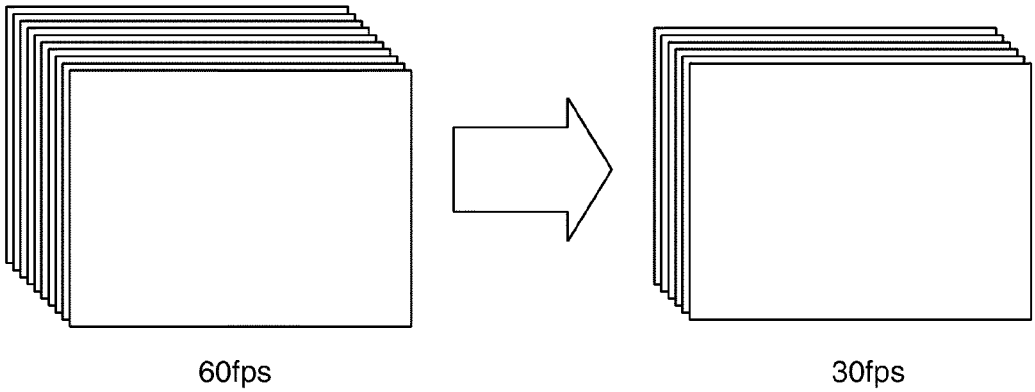
FIG. 6 is a diagram illustrating the frame rate control in a third mode.

FIG. 6 is a diagram illustrating the FRC in the third mode. FIG. 6 schematically illustrating a variation in a display image on the screen of the display panel 20 at the time of performing the FRC in the third mode.

The FRC in the third mode is a mode in which the image display is thinned out every given frames. For example, the lines of an image are displayed regardless of an even frame or an odd frame as a normal operation. When it is switched to the third mode, image data in which only even frames have the pixel values of the original image is output and image data in which odd frames are black images in which the pixel values of R components, G components, and B components in all dots of the image are "0" are generated. Accordingly, a black image is displayed in the odd frames and the frame rate is substantially reduced to a half. Other frame thinning-out can be performed by appropriately inserting a black image into the thinned-out frames. Accordingly, it is possible to display the pixels of an image with different brightnesses every given interval of time and to control the lighting time of the OLEDs, thereby preventing the burn-in phenomenon and extending the lifetime of the display panel 20 or the OLEDs.

Figure 7:
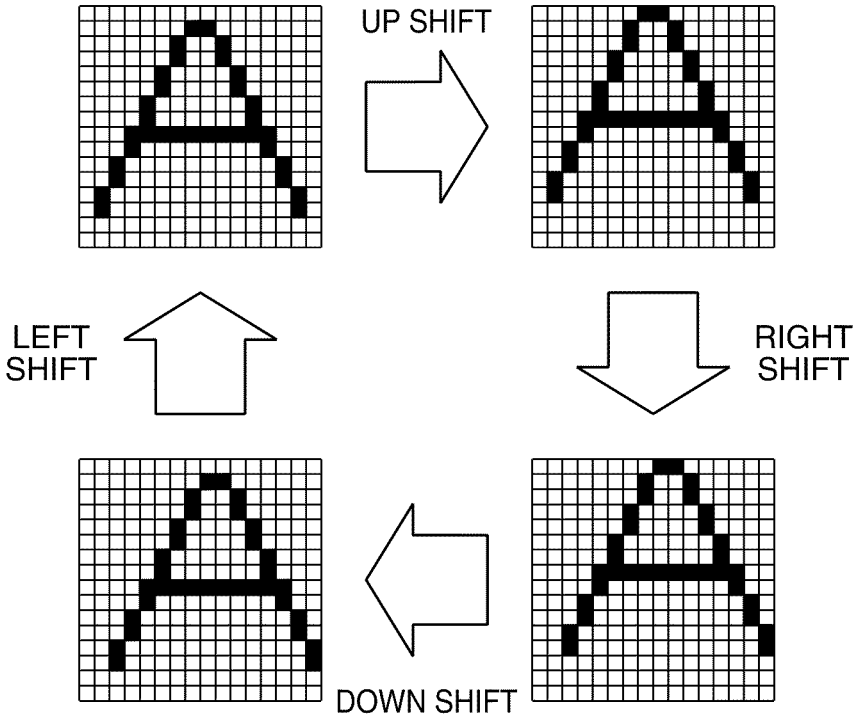
FIG. 7 is a diagram illustrating the frame rate control in a fourth mode.

FIG. 7 is a diagram illustrating the FRC in the fourth mode. FIG. 7 schematically illustrates a variation in the frame rate on the screen of the display panel 20 at the time of performing the FRC in the fourth mode.

The FRC in the fourth mode is a mode in which the original display image is shifted by a given number of dots (for example, one dot) after a second interval of time has elapsed, as shown in FIG. 7. For example, the lines of an image are displayed regardless of an even frame or an odd frame as a normal operation. When it is switched to the fourth mode, an up shift (first shift), a right shift (second shift), a down shift (third shift), and a left shift (fourth shift) are sequentially and repeatedly performed every given time. In the up shift, the original display image (or the previous display image) is shifted by one scanning line in a first vertical scanning direction on the screen of the display panel 20. In the right shift, the original display image (or the previous display image) is shifted by one dot in a first horizontal scanning direction on the screen of the display panel 20. In the down shift, the original display image (or the previous display image) is shifted by one scanning line in the opposite direction of the first vertical scanning direction on the screen of the display panel 20. In the left shift, the original display image (or the previous display image) is shifted by one dot in the opposite direction of the first horizontal scanning direction on the screen of the display panel 20. Accordingly, it is possible to display the pixels of an image with different brightnesses every given interval of time and to control the lighting time of the OLEDs, thereby preventing the burn-in phenomenon and extending the lifetime of the display panel 20 or the OLEDs.

Figure 8:
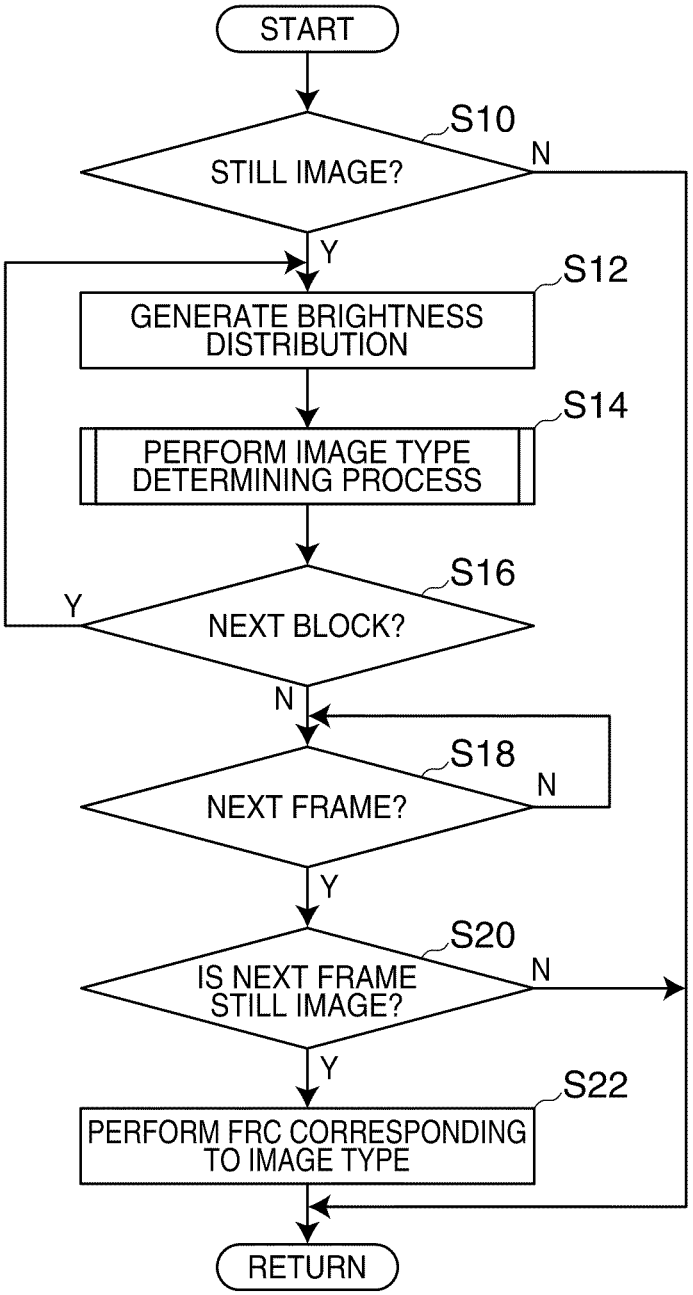
FIG. 8 is a flow diagram illustrating the flow of operations of the image processing device.

FIG. 8 is a flow diagram illustrating the flow of operations of the image processing device 100.

The image processing device 100 is constructed by an ASIC (Application Specific Integrated Circuit) or dedicated hardware and the hardware corresponding to the units shown in FIG. 2 can perform the processes corresponding to the steps shown in FIG. 8. Alternatively, the image processing device 100 may include a CPU (Central Processing Unit), a ROM (Read Only Memory), and a RAM (Random Access Memory). In this case, the processes corresponding to the steps shown in FIG. 8 can be performed by allowing the CPU having read a program stored in the ROM or the RAM to perform the processes corresponding to the program.

First, in the image processing device 100, the still image determining unit 110 determines whether an image corresponding to image data is a still image on the basis of the image data from the host 200 (step S10). When it is determined in step S10 that the image data from the host 200 is image data of a still image (Y in step S10), the FRC corresponding to the type of the image determined depending on the image types is performed in terms of a block which is obtained by dividing a screen into plural blocks.

In the image processing device 100, the YUV converter 120 converts the image data into YUV data and the brightness distribution information generator 130 generates the x-direction brightness distribution and the y-direction brightness distribution in terms of the block (step S12). In the image processing device 100, the image type determining unit 140 determines the type of the image corresponding to the image data from the host 200 in terms of the block on the basis of the x-direction brightness distribution and the y-direction brightness distribution generated in step S12 (step S14).

When a next block exists (Y in step S16), the image processing device 100 generates the x-direction brightness distribution and the y-direction brightness distribution again on the basis of the image of the next block in step S12. In FIG. 8, the processes of steps S12 and S14 are repeatedly performed for each block, but the brightness distribution of each block may be generated for all the blocks in step S12 and then the type of the image of each block may be determined in step S14.

When it is determined in step S16 that a next block does not exist (N in step S16), the image processing device 100 fetches a frame next to the frame in which it has been determined in step S10 whether the image is a still image (N in step S18). When it is determined in step S18 that the next frame is a still image (Y in step S18 and Y in step S20), the FRC corresponding to the image type determined in step S14 is performed in terms of the block (step S22 and return).

On the other hand, when it is determined in step S10 that the image data from the host 200 is not the image data of a still image (N in step S10), the input of image data of a next image from the host 200 is waited for (return). When it is determined in step S20 that the image of the next frame is not a still image (N in step S20), the image processing device 100 does not perform the FRC on the image of the next frame and waits for the input of image data of a next image from the host 200 (return). In this way, the image processing device 100 performs the FRC corresponding to the type on a frame next to the frame of which the image type is determined by the image type determining unit 140. However, the image processing device 100 determines that the image data of the next frame is a moving image and does not perform the FRC.

FIGS. 9A and 9B are diagrams illustrating the brightness distribution generating process of step S12 shown in FIG. 8.

In step S12, a histogram of absolute values of brightness differences between adjacent dots is generated as a brightness distribution. For example, when the brightness distribution in the horizontal direction of an image is generated, the x-direction brightness distribution information generator 132 calculates the brightness components of the dots every line and generates the brightness differences (of which numbers subsequent to the decimal point are discarded) between the adjacent dots, as shown in FIG. 9A. The x-direction brightness distribution information generator 132 sums up the brightness differences between the dots every two levels and generates the x-direction brightness distribution information as shown in FIG. 9B. FIG. 9B shows an example of the summing-up result of the count numbers every two levels in brightness difference. In FIG. 9B, the count numbers are summed up every two levels in brightness difference, but it is preferable that it can be set to sum up the count numbers every desired levels. The x-direction brightness distribution information generator 132 repeatedly sums up the count numbers of the lines by the number of display lines as shown in FIG. 9B to generate the brightness distribution of one screen. The y-direction brightness distribution information generator 134 repeatedly sums up the count numbers in brightness difference among the dots arranged in the vertical direction of the image to generate the brightness distribution of one screen, similarly.

Figure 10:
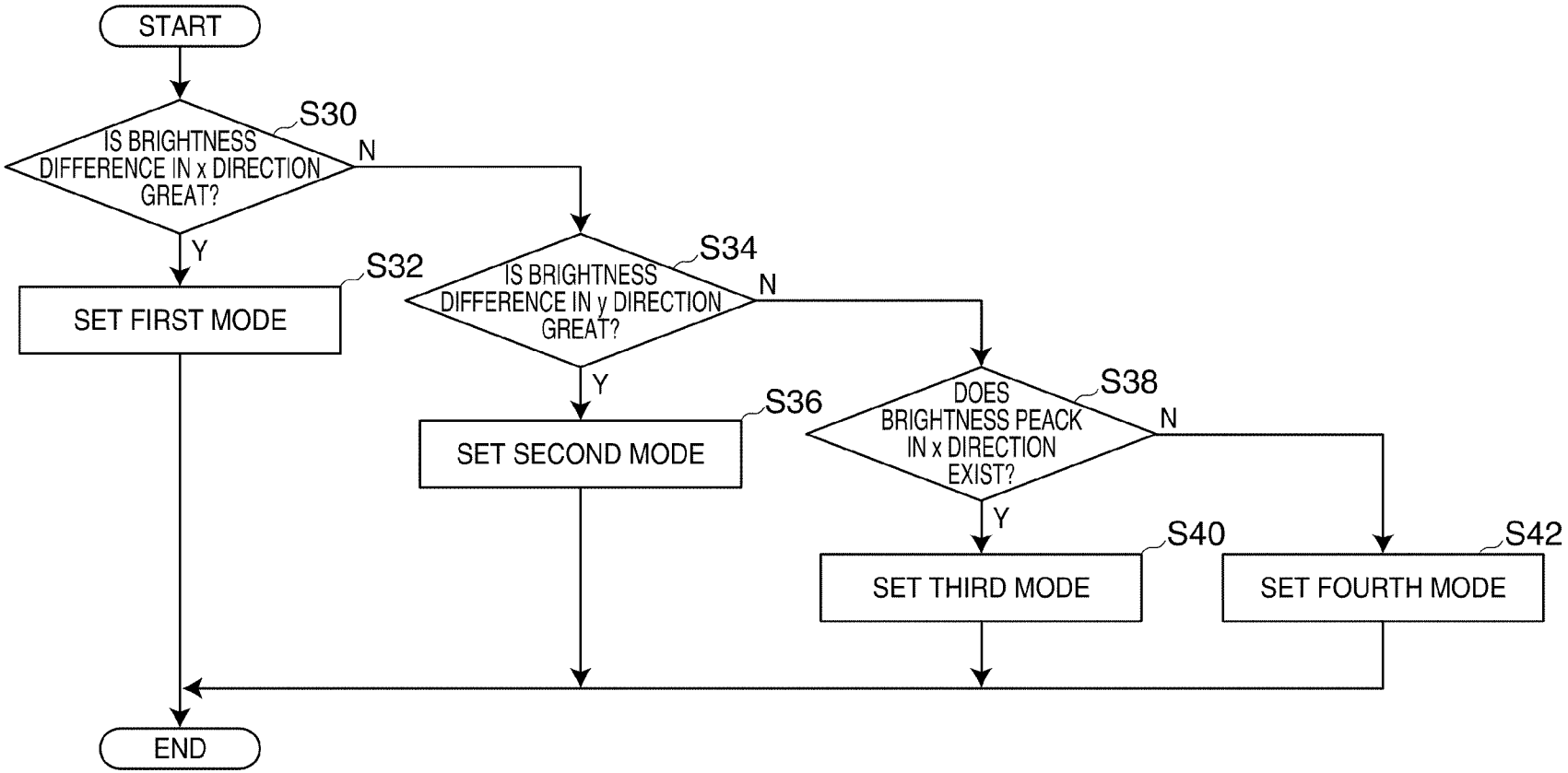
FIG. 10 is a flow diagram illustrating the flow of an image type determining process of step S14 in FIG. 8.

FIG. 10 is a flow diagram illustrating the flow of the image type determining process of step S14 in FIG. 8.

Figure 11A:
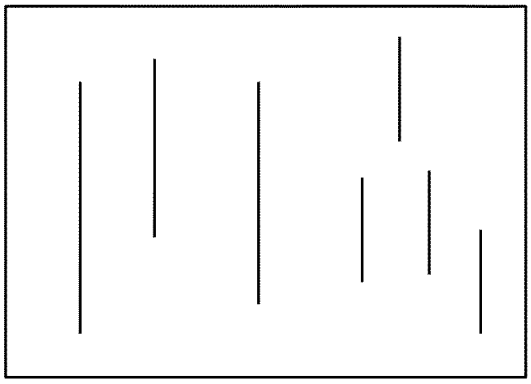
FIGS. 11A to 11C are diagrams illustrating the process of step S30 in FIG. 10.
Figure 11B:
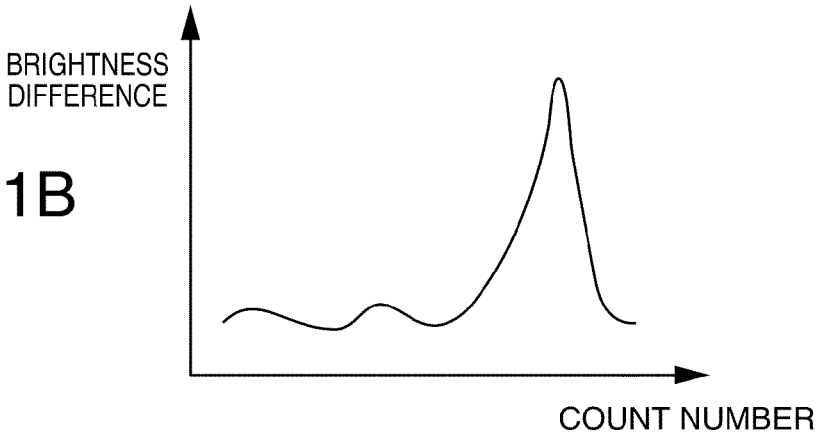
Figure 11C:
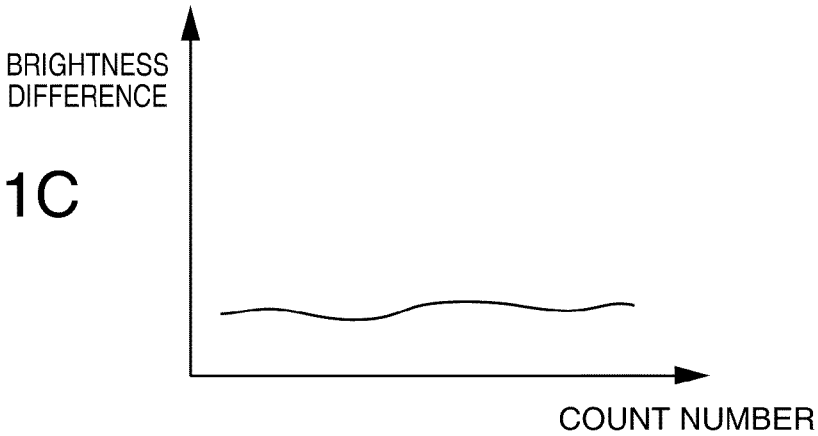

FIGS. 11A, 11B, and 11C are diagrams illustrating the process of step S30 in FIG. 10. FIG. 11A shows an example of an image (corresponding to one block) determined in step S30. FIG. 11B schematically illustrates an example of the brightness distribution in the x direction of the image shown in FIG. 11A. FIG. 11C schematically illustrates the brightness distribution in the y direction of the image shown in FIG. 11A.

Figure 12A:
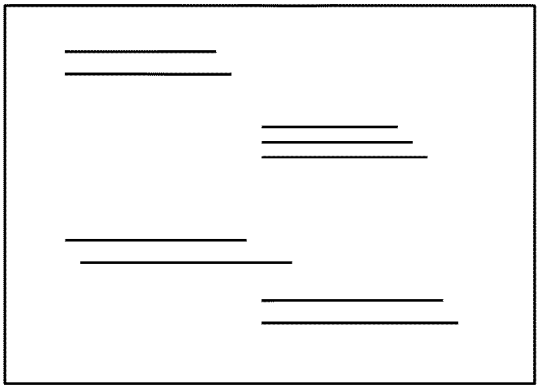
FIGS. 12A to 12C are diagrams illustrating the process of step S34 in FIG. 10.
Figure 12B:
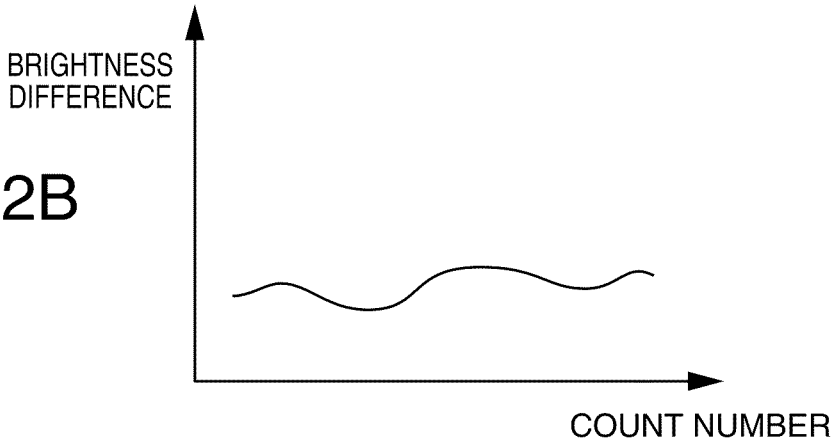
Figure 12C:
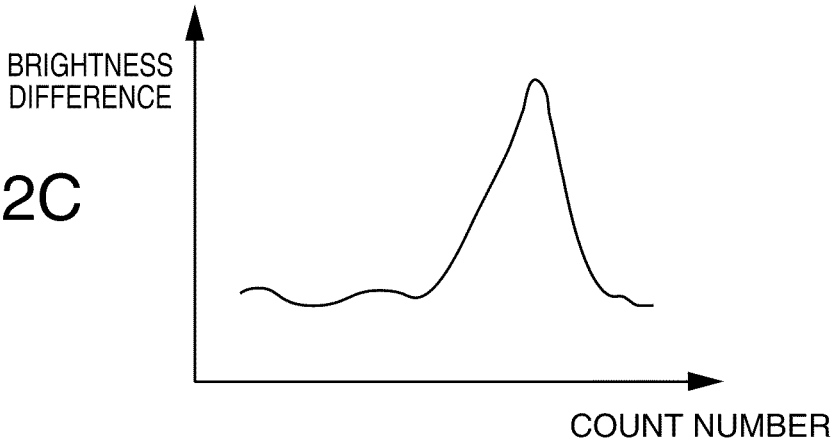

FIGS. 12A, 12B, and 12C are diagrams illustrating the process of step S34 in FIG. 10. FIG. 12A shows an example of an image (corresponding to one block) determined in step S34. FIG. 12B schematically illustrates an example of the brightness distribution in the x direction of the image shown in FIG. 12A. FIG. 12C schematically illustrates the brightness distribution in the y direction of the image shown in FIG. 12A.

Figure 13A:
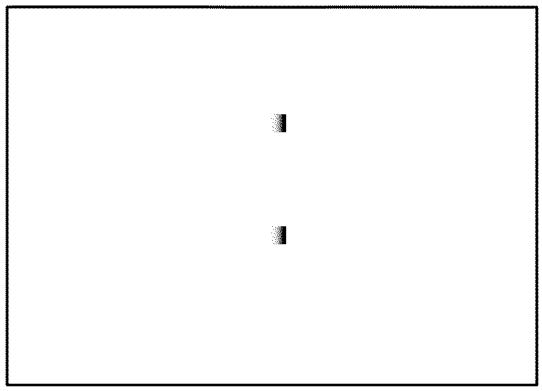
FIGS. 13A to 13C are diagrams illustrating the process of step S38 in FIG. 10.
Figure 13B:
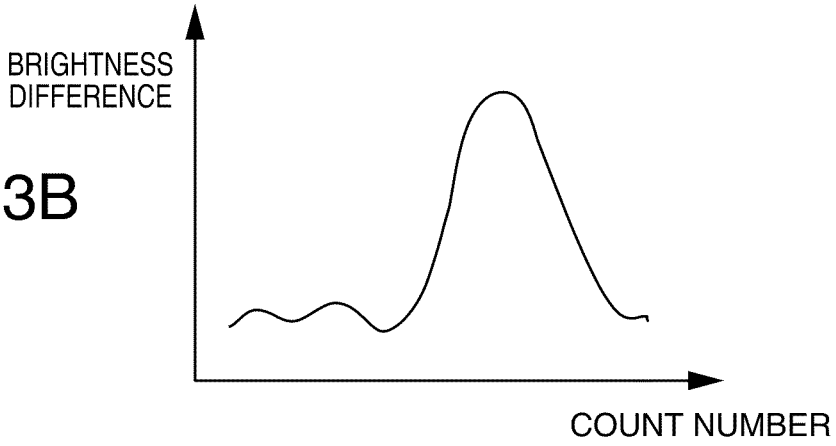
Figure 13C:
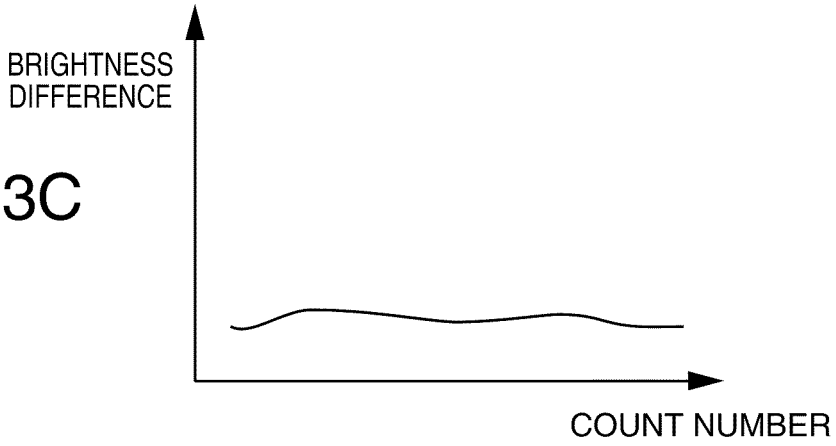

FIGS. 13A, 13B, and 13C are diagrams illustrating the process of step S38 in FIG. 10. FIG. 13A illustrates an example of an image (corresponding to one block) determined in step S38. FIG. 13B schematically illustrates an example of the brightness distribution in the x direction of the image shown in FIG. 13A. FIG. 13C schematically illustrates the brightness distribution in the y direction of the image shown in FIG. 13A.

Figure 14A:
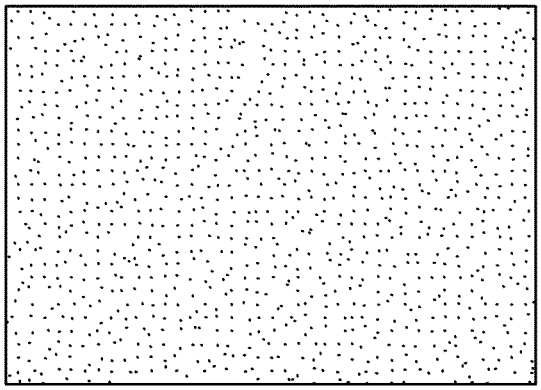
FIGS. 14A to 14C are diagrams illustrating the process of step S38 in FIG. 10.
Figure 14B:
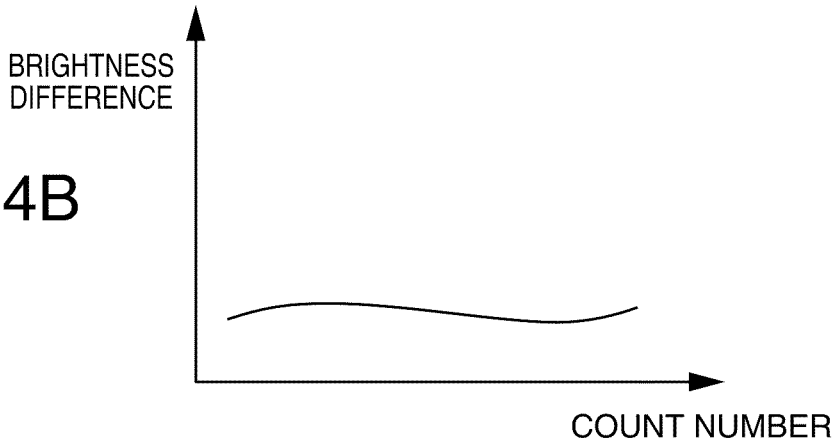
Figure 14C:
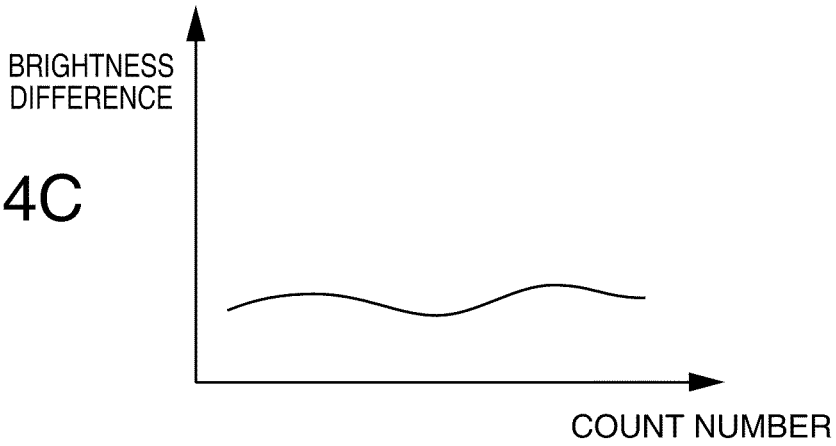

FIGS. 14A, 14B, and 14C are other diagrams illustrating the process of step S38 in FIG. 10. FIG. 14A illustrates an example of an image (corresponding to one block) determined in step S38. FIG. 14B schematically illustrates an example of the brightness distribution in the x direction of the image shown in FIG. 14A. FIG. 14C schematically illustrates the brightness distribution in the y direction of the image shown in FIG. 14A.

The image processing device 100 analyzes the x-direction brightness distribution and the y-direction brightness distribution on the basis of the image data of the block in step S14. Specifically, the image type determining unit 140 first calculates sample variances in the x-direction brightness distribution and the y-direction brightness distribution. The image type determining unit 140 determines what variance level of 16 levels the sample variances in the x-direction brightness distribution and the y-direction brightness distribution correspond to. The image type determining unit 140 determines in which direction of the z direction and the y direction the brightness difference in the image is greater on the basis of the variance level in the x direction and the variance level in the y direction. For example, when the variance level in the x direction is 12 and the variance level in the y direction is 1, it is determined that it is an image of which the brightness difference in the horizontal direction is greater. For example, when the variance level in the x direction is 5 and the variance level in the y direction is 10, it is determined that it is an image of which the brightness difference in the vertical direction is greater.

In this way, the image processing device 100 determines which of the brightness difference in the x direction and the brightness difference in the y direction is greater in step S14 (steps S30 and S34).

The image processing device 100 manages in what mode of the first mode to the fourth mode to perform the FRC in terms of the block. In step S30, it is determined in terms of the block whether the brightness difference in the x direction exists as shown in FIG. 11B and the brightness difference in the y direction does not exist as shown in FIG. 11C. When it is determined that the brightness difference in the x direction exists (Y in step S30), the image type determining unit 140 determines that the image of the block is an image shown in FIG. 11A and sets the block to be subjected to the FRC in the first mode (step S32). Thereafter, the image processing device 100 ends the flow of processes (End).

When it is determined in step S30 that the brightness difference in the x direction does not exist (N in step S30), the image type determining unit 140 determines whether the brightness difference in the x direction does not exist as shown in FIG. 12B and the brightness difference in the y direction exists as shown in FIG. 12C in terms of the block. When it is determined that the brightness difference in the y direction exists (Y in step S34), the image type determining unit 140 determines that the image of the block is an image shown in FIG. 12A and sets the block to be subjected to the FRC in the second mode (step S36). Thereafter, the image processing device 100 ends the flow of processes (End).

When it is determined in step S34 that the brightness difference in the y direction does not exist (N in step S34), the image type determining unit 140 determines whether a brightness peak with a predetermined with equal to or higher than a given brightness difference level in the x direction exists in terms of the block (step S38). For example, it is determined in step S38 whether the brightness peak in the x direction exists as shown in FIG. 13B and the brightness peak in the y direction does not exist as shown in FIG. 13C. When it is determined that the brightness peak in the x direction exists (Y in step S38), the image type determining unit 140 determines that the image of the block is an image shown in FIG. 13A and sets the block to be subjected to the FRC in the third mode (step S40). Thereafter, the image processing device 100 ends the flow of processes (End). In step S40, the block may be set to be subjected to the FRC in the first mode.

On the other hand, when it is determined that the brightness peak in the x direction does not exist (N in step S38), the image type determining unit 140 determines that the image of the block is an image shown in FIG. 14A. Then, the image type determining unit 140 sets the block to be subjected to the FRC in the fourth mode (step S42). Thereafter, the image processing device 100 ends the flow of processes (End). The image shown in FIG. 14C is an image having the brightness distribution in the x direction shown in FIG. 14B and the brightness distribution in the y direction shown in FIG. 14C and is, for example, a solid image or a natural image.

As described above, the image processing device 100 performs the FRC corresponding to the image type determined by the image type determining unit 140 in terms of the block. Accordingly, it is possible to reduce the flickering due to the FRC and to display an image with higher image quality regardless of the display panel or the display image. Compared with the normal operation, it is possible to reduce the number of lighting times of each dot or to shorten the lighting time, thereby preventing the burn-in phenomenon. As a result, it is possible to extend the lifetime of the display panel 20 or the OLED.

The display system 10 according to this embodiment can be applied to, for example, the following electronic apparatuses.

Figure 15A:
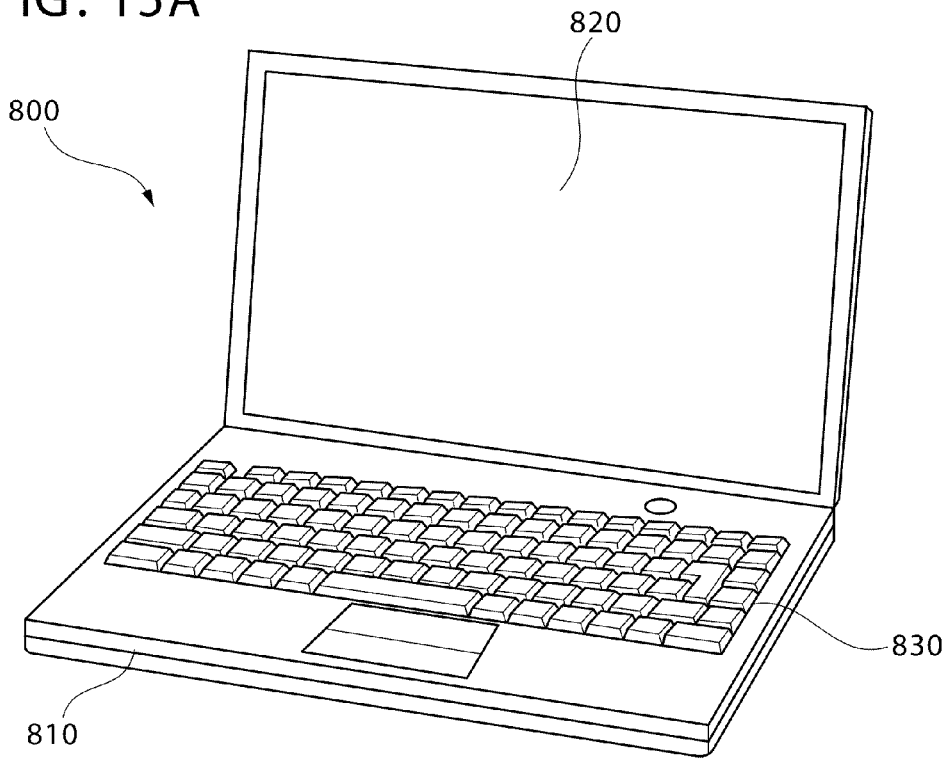
FIGS. 15A and 15B are perspective views illustrating electronic apparatuses to which the display system according to the embodiment of the invention is applied.
Figure 15B:
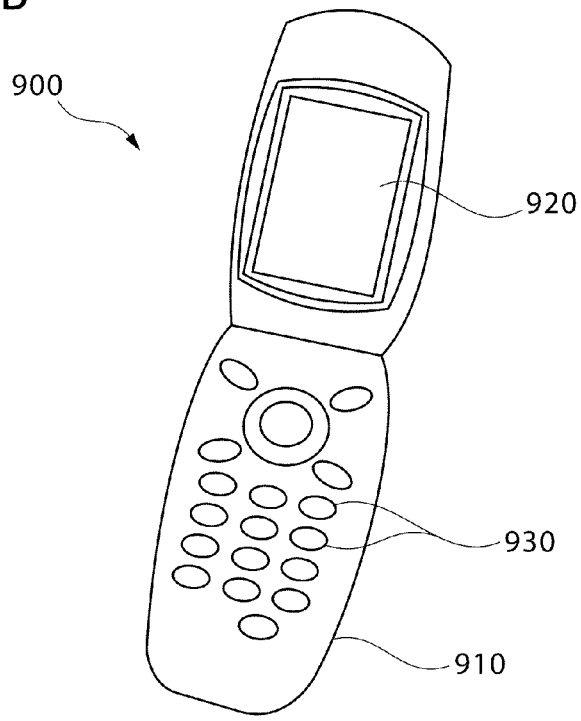

FIGS. 15A and 15B are perspective views illustrating electronic apparatuses to which the display system 10 according to this embodiment is applied. FIG. 15A is a perspective view illustrating the configuration of a mobile type personal computer. FIG. 15B is a perspective view illustrating the configuration of a mobile phone.

The personal computer 800 shown in FIG. 15A includes a body unit 810 and a display unit 820. The display system 10 according to this embodiment is mounted as the display unit 820. The body unit 810 includes the host 200 of the display system 10. The body unit 810 also includes a keyboard 830. That is, the personal computer 800 includes at least the image processing device 100 according to the above-mentioned embodiment. The operation information input through the keyboard 830 is analyzed by the host 200 and an image corresponding to the operation information is displayed on the display unit 820. Since the display unit 820 employs the OLEDs as display elements, it is possible to provide a personal computer 800 having a screen with a wide viewing angle.

The mobile phone 900 shown in FIG. 15B includes a body unit 910 and a display unit 920. The display system 10 according to this embodiment is mounted as the display unit 920. The body unit 910 includes the host 200 of the display system 10. The body unit 810 also includes a keyboard 930. That is, the mobile phone 900 includes at least the image processing device 100 according to the above-mentioned embodiment. The operation information input through the keyboard 930 is analyzed by the host 200 and an image corresponding to the operation information is displayed on the display unit 920. Since the display unit 920 employs the OLEDs as display elements, it is possible to provide a mobile phone 900 having a screen with a wide viewing angle.

The electronic apparatus to which the display system 10 according to this embodiment is applied is not limited to the examples shown in FIGS. 15A and 15B, but examples thereof include a personal digital assistants (PDA), a digital still camera, a television, a video camera, a car navigation apparatus, a pager, an electronic pocketbook, an electronic paper, a computer, a word processor, a work station, a television phone, a POS (Point of Sale) terminal, a printer, a scanner, a copier, a vide player, and an apparatus having a touch panel.

Although the image processing device, the display system, the electronic apparatus, and the image processing method according to the embodiment of the invention has been described, the invention is not limited to the embodiment. For example, the invention can be modified in various forms without departing from the concept of the invention and include the following modifications.

(1) Although it has been described in this embodiment that the FRC is performed in any one of four modes, the details or types of the FRC are not limited to this configuration. Any one or a combination of plural types of FRC may be performed depending on the image type determined for each block.

(2) Although the display system employing the OLED has been exemplified in this embodiment, the invention is not limited to this configuration.

(3) Although it has been described in this embodiment that an image is shifted by one dot or one scanning line, the invention is not limited to this configuration and the image may be shifted by one pixel, or by plural dots, or by plural scanning lines.

(4) It has been described in this embodiment that the invention is embodied by the image processing device, the display system, the electronic apparatus, and the image processing method, the invention is not limited to this configuration. For example, the invention may be embodied by a program in which the procedure of the above-mentioned image processing method is described or by a recording medium having the program recorded thereon.

What is claimed is:

1. An image processing device performing a frame rate control on image data corresponding to a display image or a display timing control signal corresponding to the image data, comprising:

a brightness distribution generating unit that generates a brightness distribution on the basis of the image data in terms of a block which is obtained by dividing the display image on a screen into a plurality of blocks;

an image type determining unit that determines a type of an image on the basis of the brightness distribution in terms of the block; and a frame rate control unit that performs frame rate control corresponding to the determined image type in terms of the block, wherein the brightness distribution generating unit includes:

a first brightness distribution generator that generates the brightness distribution in a first direction of the display image; and a second brightness distribution generator that generates the brightness distribution in a second direction of the display image intersecting the first direction, and wherein the image type determining unit determines the type of an image on the basis of the brightness distribution in the first direction and the brightness distribution in the second direction; and wherein the frame rate control unit outputs the image data and the display timing control signal in a mode corresponding to the image type determined by the image type determining unit between a first mode in which an interlaced scanning operation and a progressive scanning operation are switched after each first interval of time, a second mode in which a frame rate decreases every dot, a third mode in which an image display is thinned out every given frame, and a fourth mode in which an image is shifted by one dot relative to the original display image after a second interval of time has elapsed.

2. The image processing device according to claim 1, wherein the frame rate control unit performs the frame rate control corresponding to the image type on a frame subsequent to the frame of which the image type is determined by the image type determining unit.

3. The image processing device according to claim 1, wherein the image type determining unit determines the image type when the display image is a still image.

4. A display system comprising:

a display panel that includes a plurality of row signal lines, a plurality of column signal lines disposed to intersect the plurality of row signal lines, and a plurality of light-emitting elements each being specified by one of the plurality of row signal lines and one of the plurality of column signal lines and emitting light with a brightness corresponding to driving current;

a row driver that drives the plurality of row signal lines;

a column driver that drives the plurality of column signal lines; and the image processing device according to claim 1, wherein the display image is displayed on the basis of the image data or the display timing control signal having been subjected to the frame rate control by the image processing device.

5. An electronic apparatus comprising the image processing device according to claim 1.

6. An image processing method of performing a frame rate control on image data corresponding to a display image or a display timing control signal corresponding to the image data, comprising:

generating a brightness distribution on the basis of the image data in terms of a block which is obtained by dividing the display image on a screen into a plurality of blocks;

determining a type of an image on the basis of the brightness distribution in terms of the block; and performing the frame rate control corresponding to the determined image type in terms of the block, wherein the performing of the frame rate control includes outputting the image data and the display timing control signal in a mode corresponding to the determined image type between a first mode in which an interlaced scanning operation and a progressive scanning operation are switched after each first interval of time, a second mode in which a frame rate decreases every dot, a third mode in which an image display is thinned out every given frame, and a fourth mode in which an image is shifted by one dot relative to the original display image after a second interval of time has elapsed.

7. The image processing method according to claim 6, wherein the determining of the image type includes determining the image type when the display image is a still image.

* * * * *